US005701569A

United States Patent [19]

Kanazawa et al.

[11] Patent Number: 5,701,569

[45] Date of Patent: Dec. 23, 1997

[54] IMAGE FORMING APPARATUS WITH TRANSFER MEMBER AND PARALLEL CIRCUIT OF GROUNDED ELECTRODE AND POWER SUPPLY

[75] Inventors: Masaharu Kanazawa, Suita; Toshiya Natsuhara, Takarazuka; Kazuyoshi Hara, Toyohashi; Yasuo Tanaka, Okazaki, all of Japan

[73] Assignee: Minolta Co., Ltd., Osaka, Japan

[21] Appl. No.: 648,750

[22] Filed: May 16, 1996

[30] Foreign Application Priority Data

May 17, 1995 [JP] Japan ..... 7-118272
Nov. 13, 1995 [JP] Japan ..... 7-319730

[51] Int. Cl.[6] ..... G03G 15/16

[52] U.S. Cl. ..... 399/308; 399/314

[58] Field of Search ..... 355/271, 272, 355/274, 275; 399/302, 303, 308, 314, 313

[56] References Cited

U.S. PATENT DOCUMENTS 4,401,383 8/1983 Suzuki et al. .
4,772,918 9/1988 Karasawa et al. .
4,977,430 12/1990 Florack et al. .
5,182,598 1/1993 Hara et al. .
5,287,152 2/1994 Oka et al. .
5,291,253 3/1994 Kumasaka et al. ..... 355/275
5,300,984 4/1994 Fuma et al. ..... 355/208
5,386,274 1/1995 Sanpe et al. ..... 355/215
5,461,461 10/1995 Harasawa et al. ..... 355/208
5,495,317 2/1996 Matsuda et al. ..... 355/208

FOREIGN PATENT DOCUMENTS 2-212872 8/1990 Japan .

*Primary Examiner*—Robert Beatty
*Attorney, Agent, or Firm*—McDermott, Will & Emery

[57] ABSTRACT

An image forming apparatus having a toner image carrying member which carries a toner image, an intermediate transfer member or sheet transport type transfer member opposite to the toner image carrying member, a charging device which charges the transfer member for transferring the toner image from the toner image carrying member to the intermediate transfer member or carried sheet, a grounding electrode which contacts the transfer member, an ammeter which measures an electric current through the grounding electrode, and a control device which controls the charging device based on a measured value of the ammeter so as to stabilize said measured value. A power source is connected to the charging device through a resistance and the grounding electrode is in parallel with circuit from the resistance to the toner image carrying member.

19 Claims, 17 Drawing Sheets

| | resistance values of the intermediate transfer belt | resistance values of the primary transfer roller. |
|---|---|---|
| ○ | $10^{5}\Omega$/sq | $10^{3}\Omega$ |
| △ | $10^{7}\Omega$/sq | $10^{3}\Omega$ |
| □ | $10^{9}\Omega$/sq | $10^{5}\Omega$ |

H/H : high temperature and high humidity

N/N : normal temperature and normal humidity

L/L : low temperature and low humidity

○ : low volume resistivity

□ : intermediate volume resistivity

△ : high volume resistivity

IMAGE FORMING APPARATUS WITH TRANSFER MEMBER AND PARALLEL CIRCUIT OF GROUNDED ELECTRODE AND POWER SUPPLY

BACKGROUND OF THE INVENTION

1. Field of the Invention

The present invention relates to an image forming apparatus with an intermediate transfer member such as a transfer belt, transfer drum or the like.

2. Description of the Related Art

Conventional image forming apparatus form toner images using an intermediate transfer member such as an intermediate transfer belt, intermediate transfer drum or the like. For example, color image forming methods are known which perform a secondary transfer to a transfer member after overlaying various toner images of various colors formed on a photosensitive member to an intermediate transfer member in a primary transfer. The transport path of the transfer member of the image forming apparatus can be simplified by using an intermediate transfer member, and the image forming apparatus itself can be simplified and compact in construction. In general, methods which apply a constant voltage are used in the primary transfer to transfer a toner image formed on a photosensitive member to an intermediate transfer member.

SUMMARY OF THE INVENTION

An object of the present invention is to provide an image forming apparatus with an intermediate transfer member capable of performing stable transfers.

Another object of the present invention is to provide an image forming apparatus with an intermediate transfer member capable of stable transfer output via circuits of simple construction.

A further object of the present invention is to provide an image forming apparatus with an intermediate transfer member capable of performing stable transfers with negligible fluctuation in transfer efficiency due to fluctuation of the characteristics of the intermediate transfer member over long-term use and variation of characteristics of the intermediate transfer member, as well as environmental fluctuations.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
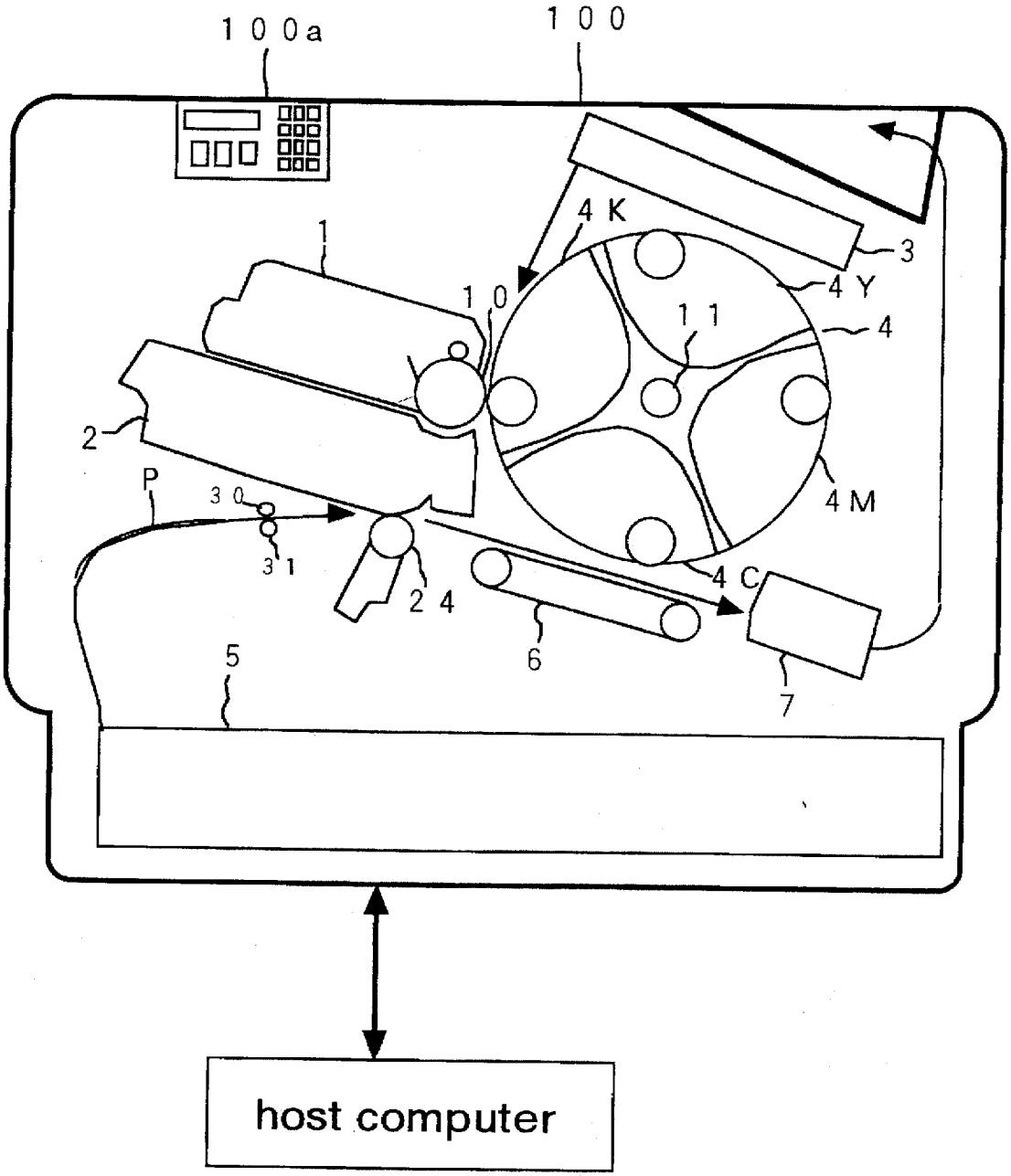
FIG. 1 is a section view of an electrophotographic type image forming apparatus of the present invention.

FIG. 1 is a section view of an electrophotographic type image forming apparatus 100 of the present invention.

Electrophotographic type image forming apparatus 100 is an electrophotographic type printer which receives data from a host computer and forms images using said data, and mainly comprises a photosensitive member unit 1, intermediate transfer member unit 2, print head 3, developing unit 4, paper cassette 5, copy sheet transport unit 6, fixing device 7 and, operation panel 100*a*.

Photosensitive member unit 1 accommodates a photosensitive member 10 around which are provided image forming elements such as chargers and cleaners and the like. Photosensitive member 10 is uniformly charged by the charging device after it is cleaned by the cleaner.

The print head 3 accommodates a laser diode, scanning optical unit or the like, and controls the laser diode in accordance with data received from a host computer, so as to form an electrostatic latent image on the uniformly charged surface of photosensitive member 10.

Developing unit 4 is provided so as to be rotatable about developing unit shaft 11. Developing unit 4 accommodates developing devices 4Y, 4M, 4C, and 4K, such that a selected developing device confronts the photosensitive member 10 via the rotation of developing unit 4. The developing device confronting photosensitive member 10 develops the electrostatic latent image formed on the surface of photosensitive member 10 as a toner image T.

Paper cassette 5 feeds printing paper P accommodated therein with a predetermined timing, and transports said sheet P between timing roller 30 and 31.

Figure 2:
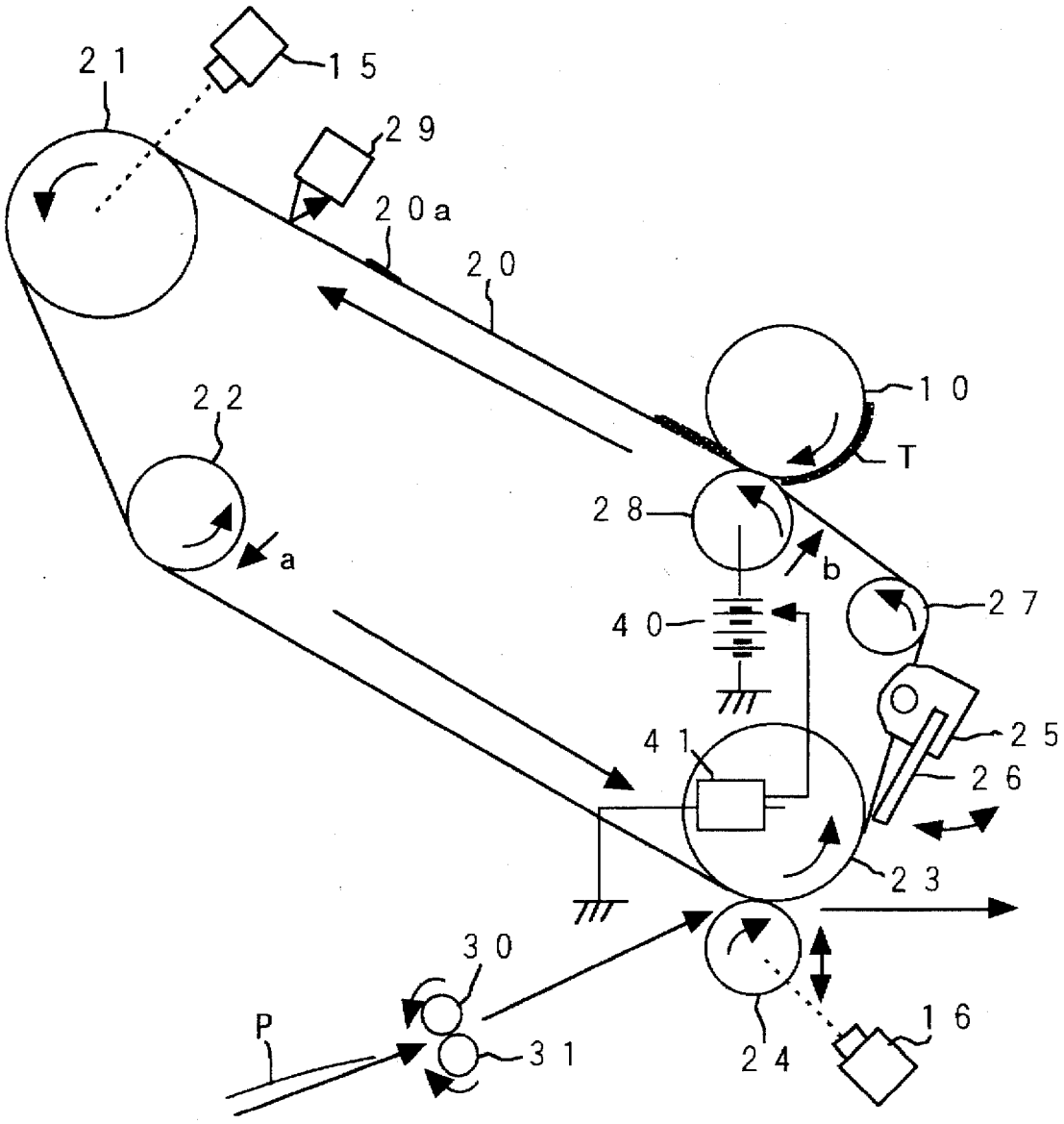
FIG. 2 is a section view showing the construction of the intermediate transfer member unit.

The construction of intermediate transfer member unit 2 is described in detail hereinafter. FIG. 2 is a section view showing the construction of intermediate transfer member unit 2.

Intermediate transfer member unit 2 mainly comprises an intermediate transfer belt 20, drive roller 21, tension roller 22, secondary transfer opposed roller 23, intermediate transfer belt cleaner 25, primary pre-transfer roller 27, and primary transfer roller 28. Intermediate transfer belt 20 is an endless belt 370 nm in circumference, 250 mm in width, and about 150 μm in thickness, formed of polycarbonate. The size of the intermediate transfer belt 20 is at least 50 mm or greater, and preferably 100 mm or greater in both the main scan and subscan directions when using a maximum paper size of A4 as the print paper. Intermediate transfer belt 20 may be a belt may be a fluororesin with a conductive filler such as carbon black or the like rather than polycarbonate.

Intermediate transfer belt 20 is supported by drive roller 21, tension roller 22, secondary transfer opposed roller 23, primary pretransfer roller 27, and primary transfer roller 28, so as to be brought into contact with the photosensitive member 10 by primary transfer roller 28. The surface of drive roller 21 is formed by a rubber material, and is rotated in the arrow direction in the drawing by the transmission of a drive force of main motor 15 via a drive transmission device such as a timing belt or the like. The rotation of drive roller 21 is communicated to intermediate transfer belt 20 such that intermediate transfer belt 20 is transported in a counterclockwise direction at the same speed as the rotation speed of photosensitive member 10. Furthermore, tension roller 22 exerts a force in the arrow a direction, so as to produce tension in intermediate transfer belt 20 to prevent slack in the belt between the various rollers. Thus, the rotation of drive roller 21 is efficiently transmitted to intermediate transfer belt 20.

The edge of intermediate transfer belt 20 is provided with a belt position detection mark 20*a*. The position of the intermediate transfer belt 20 can be detected by detecting the belt position detection mark 20*a* via a belt position sensor 29. The belt position detection mark 20*a* may be provided by methods such as providing a hole on intermediate transfer belt 20, providing a convexity, providing an area of different reflectivity or the like. The belt position sensor 29 may be a reflective type optical sensor, or transmission type optical sensor in accordance with the configuration of the belt position detection mark.

Primary transfer roller 28 comprises a metal core of aluminum, stainless steel or the like, which is wrapped in a silicone rubber, sponge or like flexible resistive element, and exerts a force in the arrow b direction so as to bring intermediate transfer belt 20 into contact with photosensitive member 10. A primary transfer current is applied to primary transfer roller 28 via a primary transfer power source 40. Primary transfer power source 40 is capable of varying the amount of current so as to change the amount of current applied to primary transfer roller 24. The toner image T formed on the surface of photosensitive member 10 is transferred to intermediate transfer belt 20 via the primary transfer current applied to primary transfer roller 28, so as to overlay the required number of color components on the surface of intermediate transfer belt 20. The overlay positions of toner images T are matched by timing via intermediate transfer belt position sensor 29. When forming monochrome images, toner image T of only a single color is transferred onto intermediate transfer belt 20, and the repeated process is not executed.

The toner image transferred to the intermediate transfer belt 20 is transported to the region opposite the secondary transfer roller 24 while adhered to the intermediate transfer belt 20. A secondary transfer opposed roller 23 is provided at the region of opposition between intermediate transfer belt 20 and secondary transfer roller 24.

Secondary transfer roller 24 comprises a core of aluminum, stainless steel or the like, which is wrapped in a flexible resistive element such as silicone rubber, sponge or the like. A secondary transfer current is applied to said secondary transfer roller 24. The secondary transfer roller 24 is capable of pressing against intermediate transfer belt 20 or retracting therefrom. Secondary transfer roller 24 is rotated in the arrow direction in the drawing via a drive force from a drive motor 16 provided separately from drive motor 15, said drive force being communicated via a drive transmission device such as a gear, pulley, timing roller or the like.

Secondary transfer opposed roller 23 comprises a core of aluminum, stainless steel or the like, which is wrapped in a flexible resistive element such as silicone rubber, sponge or the like, and which is grounded via a transfer current control device 41. Transfer current control device 41 detects the amount of current flowing from secondary transfer opposed roller 23 to the ground. Transfer current control device 41 is described in detail later.

Secondary transfer roller 24 makes contact and retracts in conjunction with the transport of print paper P; when in pressure contact the secondary transfer opposed roller 23 makes contact with print paper P through intermediate transfer belt 20. At this time, the toner image T on the intermediate transfer belt 20 is transferred to print paper P in a secondary transfer via a secondary transfer current applied to secondary transfer roller 24. Thus, overlaid toner images T are formed on print paper P.

The toner image T transferred to print paper P in the secondary transfer is transported to fixing device 7 via the copy sheet transport unit 6. The toner image T is fixed on the print paper P, and the paper P is ejected from the apparatus to end the image forming process.

Intermediate transfer belt cleaner 25 is provided with a cleaning blade 26 capable of retractably making contact with intermediate transfer belt 20. Cleaning blade 26 is formed of a flexible member such as silicone rubber, and presses against intermediate transfer belt 20 at a contact force of 200 g to remove residual toner from the surface of intermediate transfer belt 20.

Figure 3:
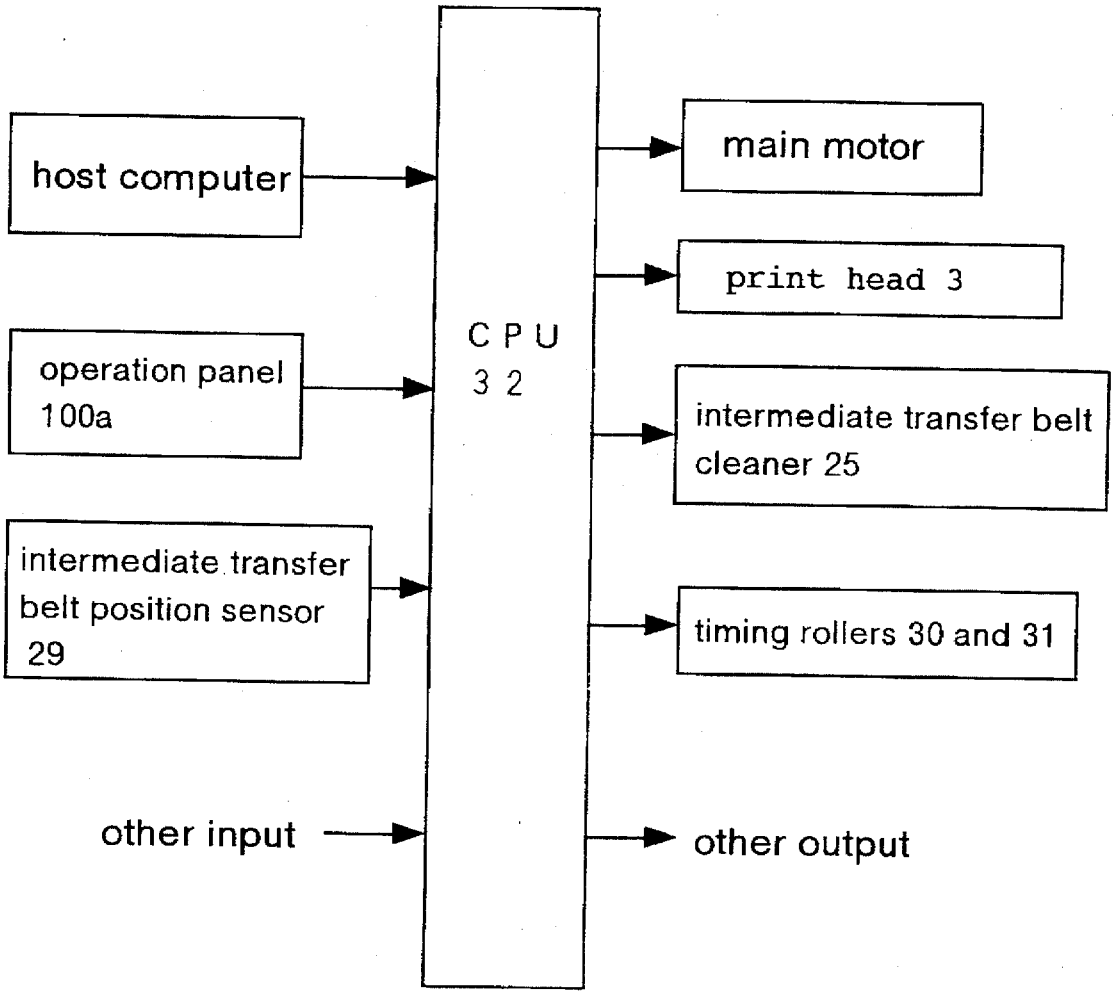
FIG. 3 is a block diagram of the control circuit of the image forming apparatus of FIG. 1.

FIG. 3 is a block diagram of the control circuit of image forming apparatus 100 of the present invention. CPU 32 controls various elements such as the main motor, print head 3, intermediate transfer belt cleaner 25, timing rollers 30 and 31 and the like in accordance with input from a host computer, operation panel 100*a*, intermediate transfer belt position sensor 29 and the like.

Figure 4:
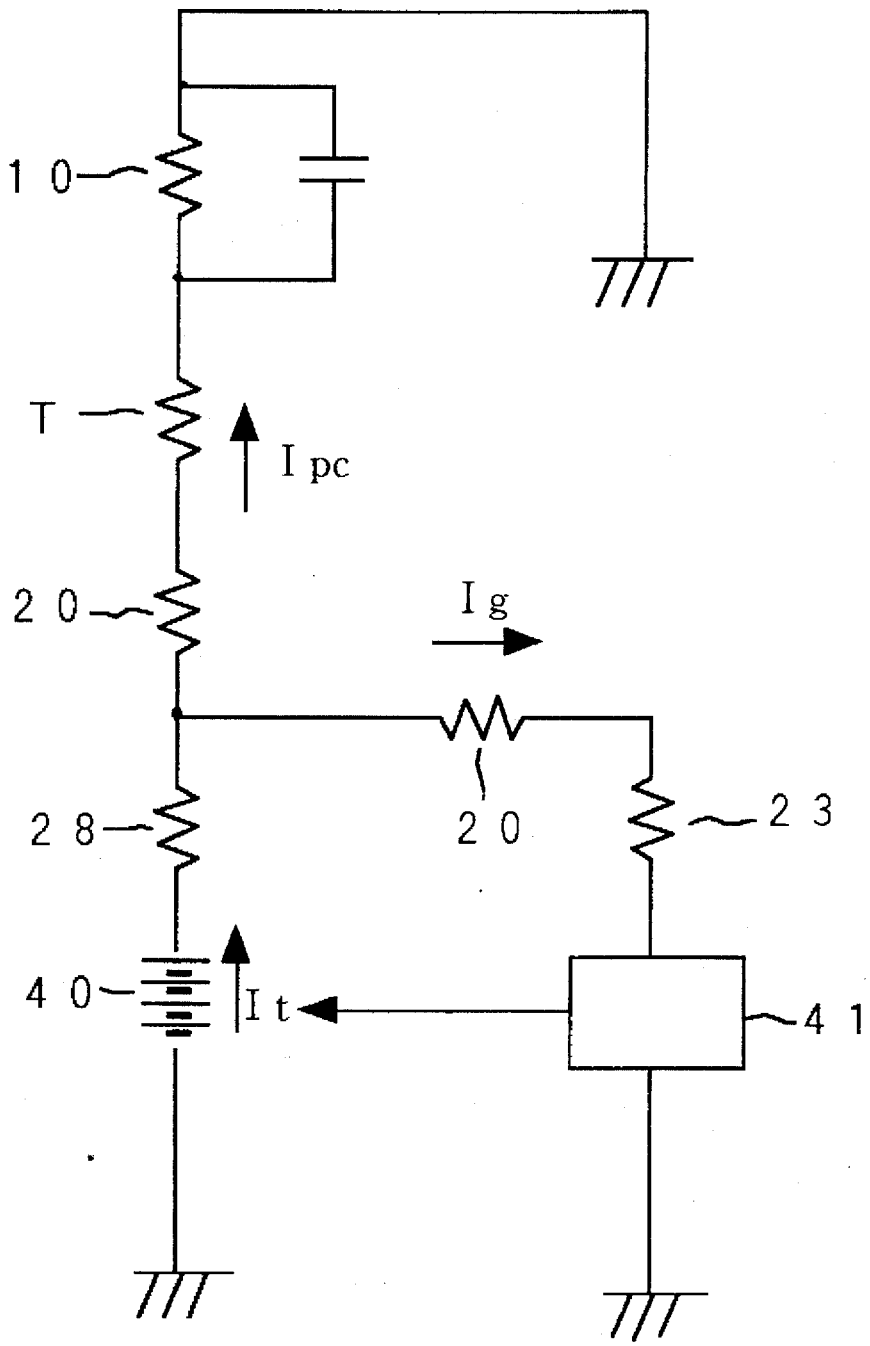
FIG. 4 is a circuit diagram showing the equivalent circuit of the intermediate transfer member unit shown in FIG. 2.

FIG. 4 is a circuit diagram showing the equivalent circuit of the primary transfer unit of the transfer device of FIG. 2.

The current It output from primary transfer power source 40 is divided into a current Ipc flowing to photosensitive member 10, and current Ig flowing to the grounded secondary transfer opposed roller 23. The current Ipc flowing to the photosensitive member 10 flows from photosensitive member 10 to the ground through transfer belt 20 and toner image T. On the other hand, the current Ig flowing to secondary transfer opposed roller 23 is transmitted to transfer belt 20 and flows from said secondary transfer opposed roller 23 to the ground. Transfer current control device 41 is disposed between secondary transfer opposed roller 23 and the ground, and measures the current Ig flowing from secondary transfer opposed roller 23 to the ground.

Actually, the current used to transfer toner image T is the current Ipc flowing to the photosensitive member 10. A detection of the current Ipc flowing to the photosensitive member 10 is difficult, however, due to the presence of current flowing from the charger to photosensitive member 10. Therefore, in the embodiment, the current Ig flowing to the secondary transfer opposed roller 23 is measured via the previously described transfer current control device 41. It can be understood from this equivalent circuit that the relationship between the current Ipc flowing to the photosensitive member 10 and the current Ig flowing to the secondary transfer opposed roller 23 is expressed by the equation below.

$$It=Ig+Ipc$$

Therefore, the same result as obtained from measuring the current Ipc flowing to photosensitive member 10 can be obtained by measuring the current Ig flowing to secondary transfer opposed roller Ig.

That is, the current Ig flowing to secondary transfer opposed roller 23 is detected by transfer current control device 41, and the primary transfer power source 40 is controlled so as to provide a current of an amount wherein a predetermined current Ipc is added to the current Ig. This control is normally accomplished during the operation of primary transfer power source 40. Accordingly, a state of equilibrium is normally maintained which can be expressed by the equation below.

$$It=Ig+Ipc$$

Figure 5:
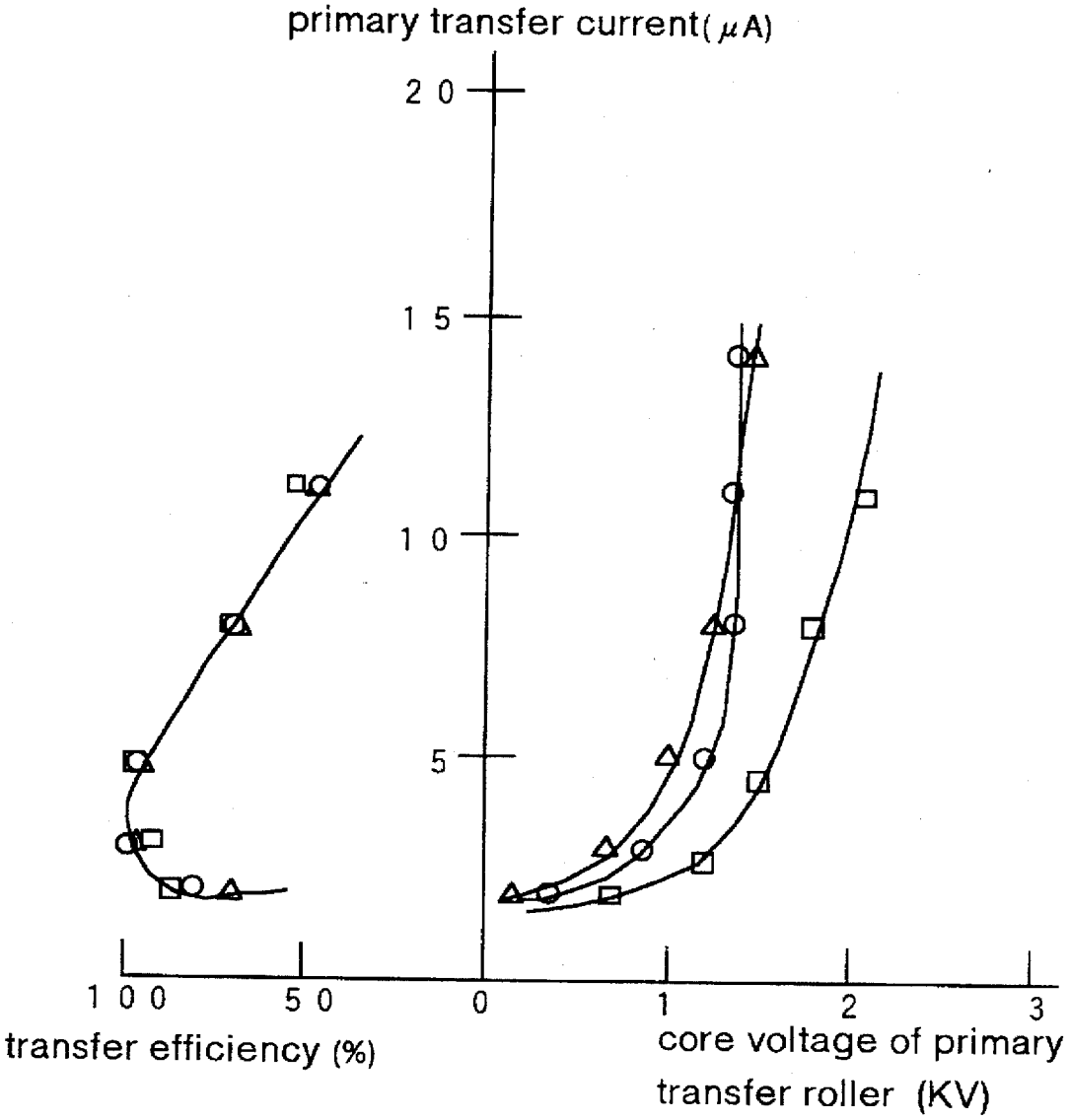
FIG. 5 is a graph plotting the primary transfer current, transfer efficiency, and primary transfer roller core voltage.

FIG. 5 is a graph showing the relationships among primary transfer current applied by primary transfer power source 40 and transfer efficiency, and the core voltage of primary transfer roller 28; the graph shows the conditions when the resistance value of intermediate transfer belt 20 and the resistance value of primary transfer roller 28 are varied.

Actually, there is a possibility that the resistance value of the intermediate transfer belt may change 1 digit, and the resistance value of the primary transfer roller may change 2 digits due to deterioration arising from long-term use.

As can be understood from the drawing, when the value of the primary transfer current is set in the range of 3 μA to 5 μA, and particularly when set at 4 μA, transfer efficiency is stable at 90% or greater regardless of the resistance values of the intermediate transfer belt and primary transfer roller.

Conversely, when the core voltage of the primary transfer roller is controlled at constant voltage and the resistance values of the intermediate transfer belt and primary transfer roller are changed, the value of the primary transfer current changes and transfer efficiency is destabilized.

For example, when the core voltage of the primary transfer roller is controlled at a constant voltage of 1.04 kV and the standard intermediate transfer belt has a surface resistance of $10^9\Omega$/sq, and the resistance of the standard primary transfer roller is $10^3\Omega$, the primary transfer current is 4 μA and the transfer efficiency is 90% or greater. When the surface resistance of the intermediate transfer belt is changed to $10^7\Omega$/sq, the primary transfer current becomes 5.9 μA and transfer efficiency drops below 90%. Similarly, when the resistance of the primary transfer roller is changed to $10^5\Omega$, the primary transfer current becomes 2.6 μA and the transfer efficiency drops to below 90%.

Thus, the transfer efficiency can be stabilized by directly detecting the primary transfer current, and controlling the output of primary transfer current power source 40.

Figure 6:
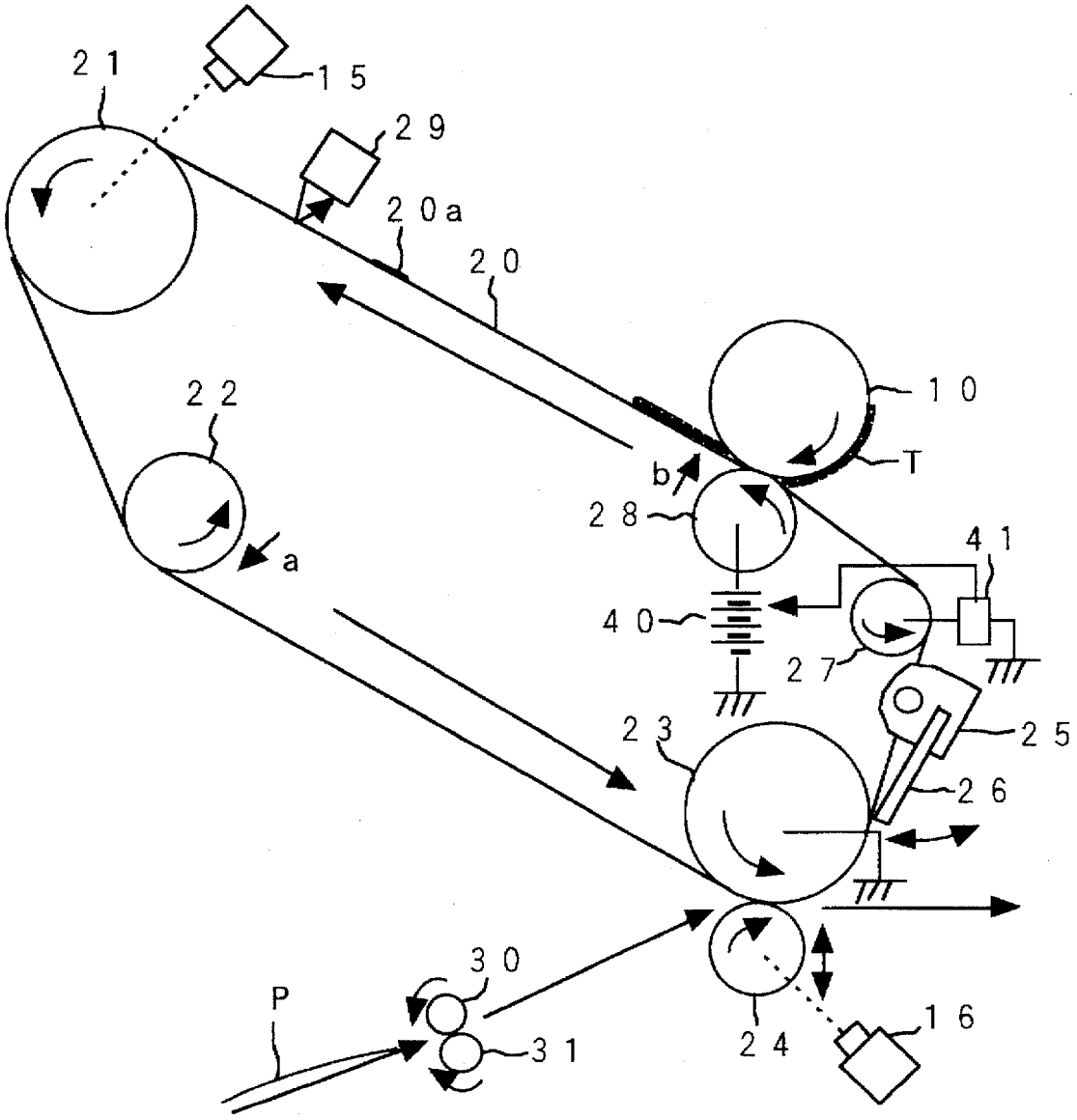
FIG. 6 is a section view of a modification of the intermediate transfer member unit of FIG. 2.

FIG. 6 shows a modification of the transfer device of FIG. 2. In this example, the primary pretransfer 27 is grounded to detect the current flowing to the ground through said primary pretransfer roller 27. Primary pretransfer roller 27 is provided between the region of confrontation between intermediate transfer belt 20 and primary transfer roller 28 and secondary transfer roller 24 so as to be in contact with intermediate transfer belt 20, and functions as a guard electrode via the grounding. The guard electrode is disposed between the primary transfer region and the secondary transfer region, as an electrode which prevents current from flowing from said primary transfer region to the secondary transfer region. The guard electrode is not limited to the primary pretransfer roller 27, and may be any electrode or roller which comes into contact with the intermediate transfer belt. When a plurality of images are output in series, the guard electrode prevents current from flowing from the primary transfer region to the secondary transfer region during the secondary transfer of a previous image. Thus, it is possible to accomplish the primary transfer of a subsequent image during the secondary transfer of a previous image.

Figure 7:
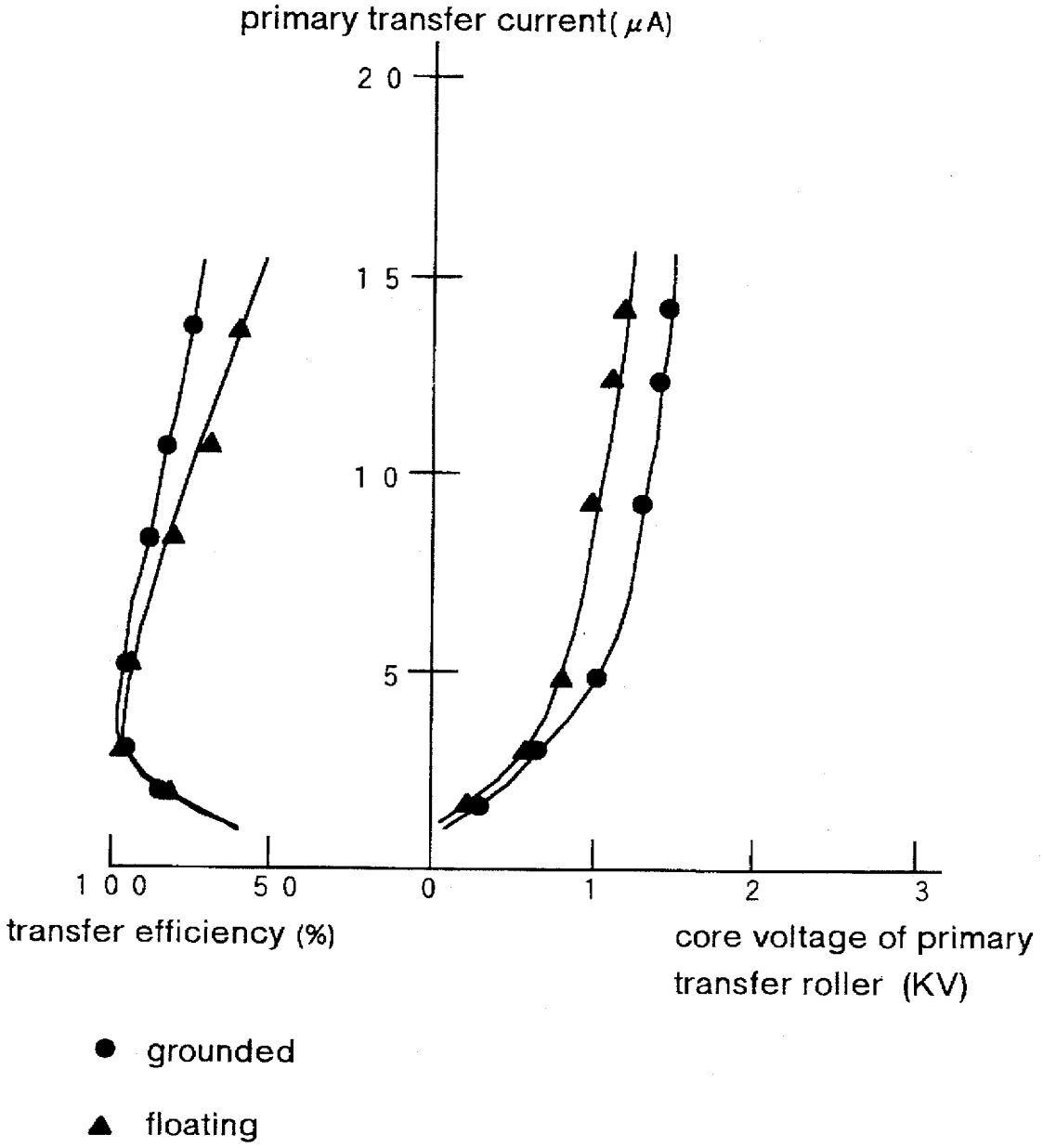
FIG. 7 is a graph plotted when the primary pre-transfer roller was grounded and floated.

FIG. 7 is a graph showing the correlations among the primary transfer current, transfer efficiency, and the core voltage of the primary transfer roller 28 when primary pretransfer roller 27 is grounded and when floating. It can be understood from this graph that transfer efficiency is best when the primary pretransfer roller 27 is grounded and used as a guard electrode.

The ground electrode connected to transfer current control device 41 may ground the intermediate transfer belt so as to detect the current flowing from the intermediate transfer belt to the ground, and is not limited to the second transfer roller or guard electrode. The present invention may also be an image forming apparatus using an intermediate transfer film, intermediate transfer drum, transfer roller or other intermediate transfer member in place of the intermediate transfer belt.

Change in the primary transfer current can normally be measured using the aforesaid transfer device, and the primary transfer current can be maintained at a constant level with excellent accuracy by controlling the amount of current of the primary transfer device applied to the intermediate transfer member based on the measured current. Thus, stable transfer efficiency can be obtained by controlling a constant current used for actually transferring the toner even when fluctuations occur due to deterioration or differences among individual intermediate transfer members.

Figure 8:
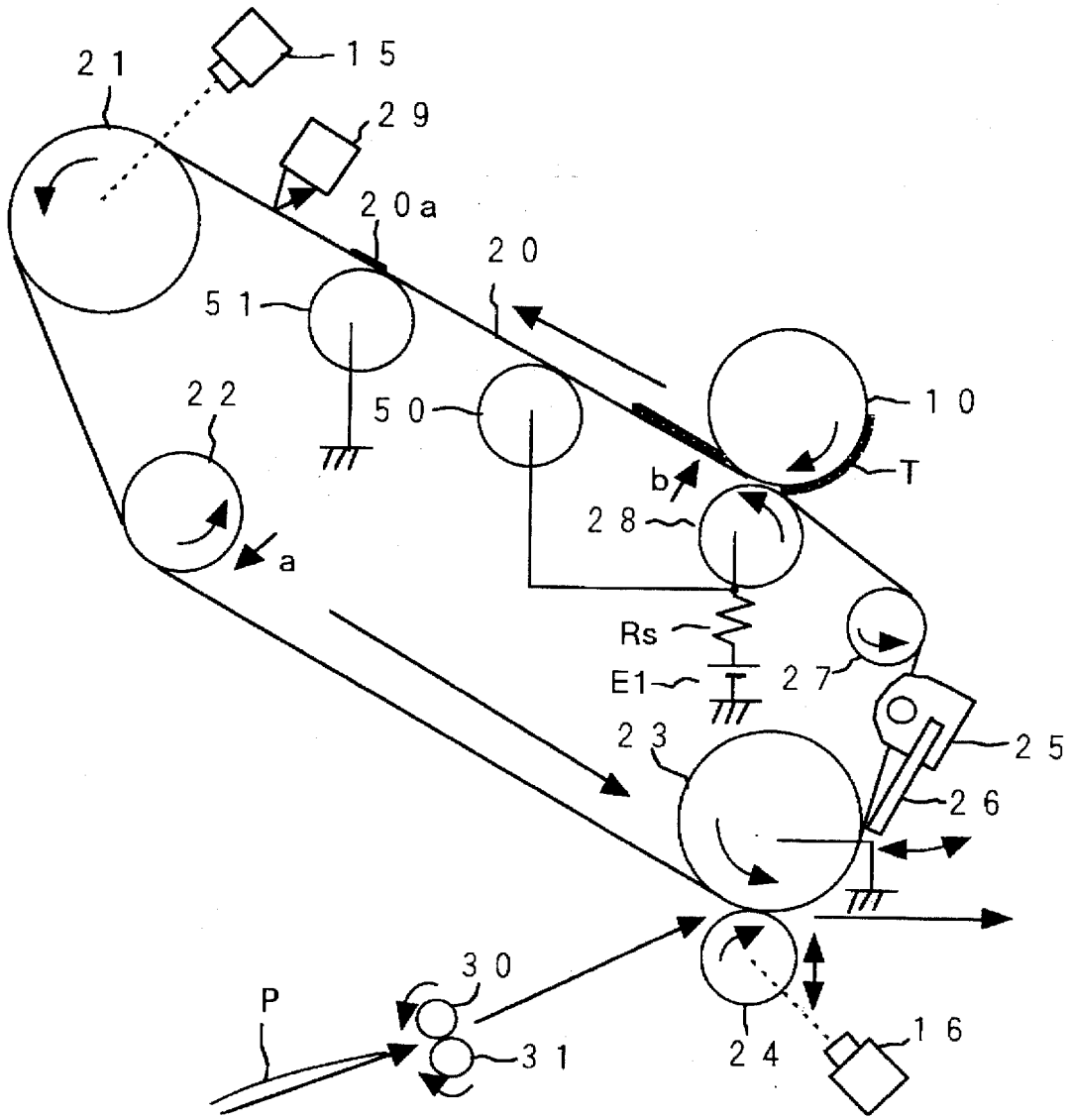
FIG. 8 is a section view showing the construction of the intermediate transfer member unit.
Figure 9:
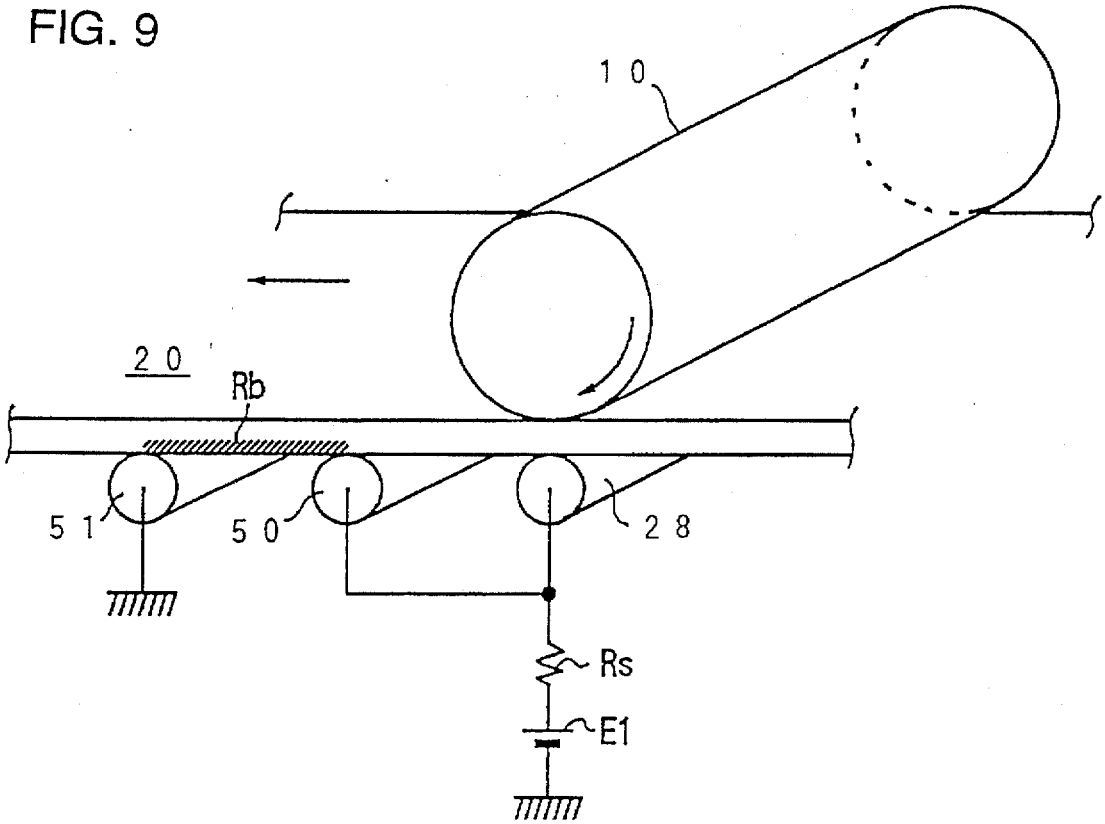
FIG. 9 is an enlarged perspective view of the essential portion of the device of FIG. 8.

FIGS. 8 and 9 show other examples of transfer devices which provide stabilized transfers.

FIG. 8 shows a transfer device having the same basic construction of the device of FIGS. 1 and 2; therefore, the following description will be abbreviated and concentrate on the transfer device and transfer regions shown in FIG. 2.

In the construction shown in FIG. 8, a transfer current control device such as that shown in the transfer device of FIG. 2 is not provided.

A primary transfer bias roller 28 identical to that of the transfer device of FIG. 2 is provided on the back side at the position at which intermediate transfer belt 20 makes contact with photosensitive member 10, and makes contact with the back side of intermediate transfer belt 20 with a force of 600 g. The primary transfer bias roller 28 is connected to a high voltage type constant voltage power source E1 via control resistance Rs. Intermediate transfer belt 20 may be a belt having a conductive filler such as carbon black or the like rather than polycarbonate.

A reference electrode roller 50 is provided behind (the advancing direction of belt 20) the primary transfer bias roller 28, so as to make contact with the back side of intermediate transfer belt 20 at a force of 600 g. Also behind bias roller 28 is provided a ground electrode 51, which makes contact with the back side of intermediate transfer belt 20 at a force of 600 g.

Figure 10:
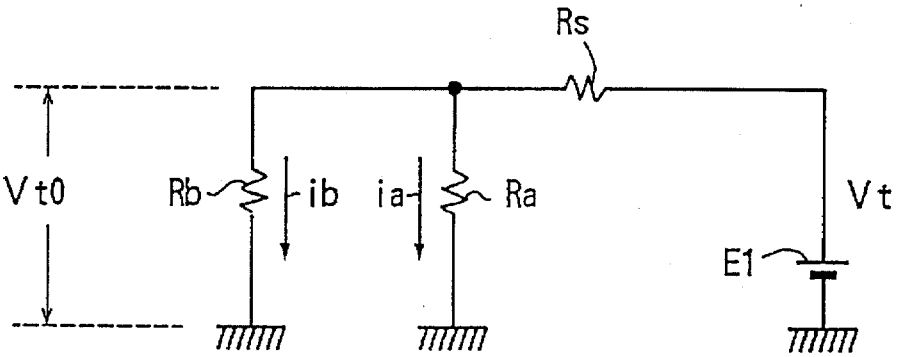
FIG. 10 is an equivalent circuit diagram showing the electrical construction of the device of FIG. 8.

In the present device, the equivalent circuit shown in FIG. 10 is provided with an intermediate transfer belt 20, primary transfer bias roller 28, control resistance Rs, constant voltage power source E1, reference electrode 50, and ground electrode 51. In FIG. 10, resistance Rb is the surface resistance of intermediate transfer belt 20 present between reference electrode 50 and ground electrode 51. Resistance Ra is the resistance of the current path from primary transfer bias roller 28, through intermediate transfer belt 20, to photosensitive member 10.

Current ia flowing through the current path from primary transfer bias roller 28 through intermediate transfer belt 20 to photosensitive drum 10 is maintained at constant level regardless of environmental fluctuations of temperature and humidity via the action of the equivalent circuit shown in FIG. 10, thereby preventing insufficient transfer and background fog during times of fluctuating environmental conditions.

Figure 11:
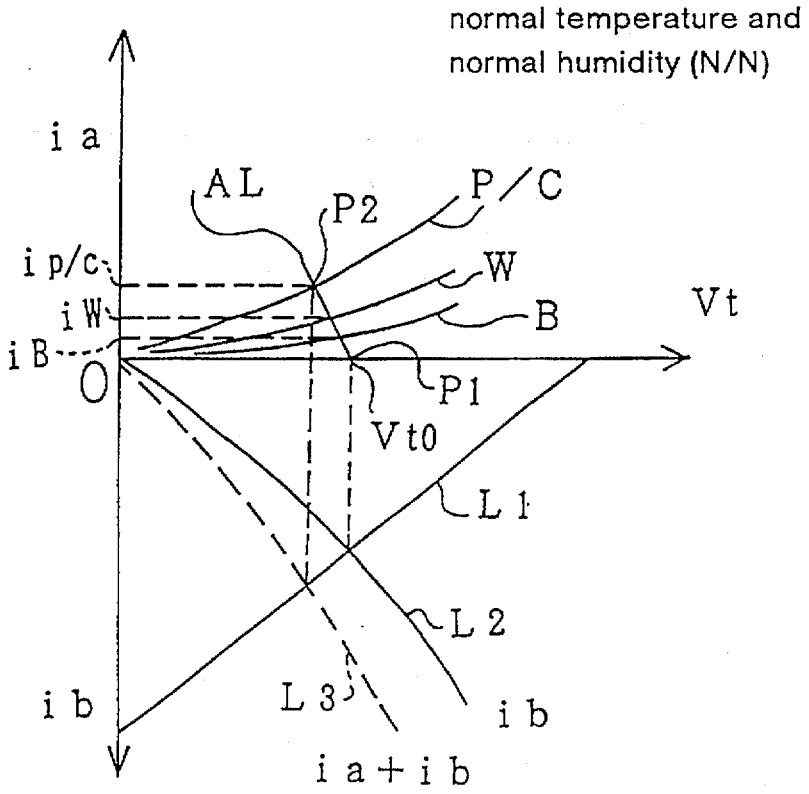
FIGS. 11, 12, and 13 respectively show graphs illustrating the principle of the device of FIG. 8.
Figure 12:
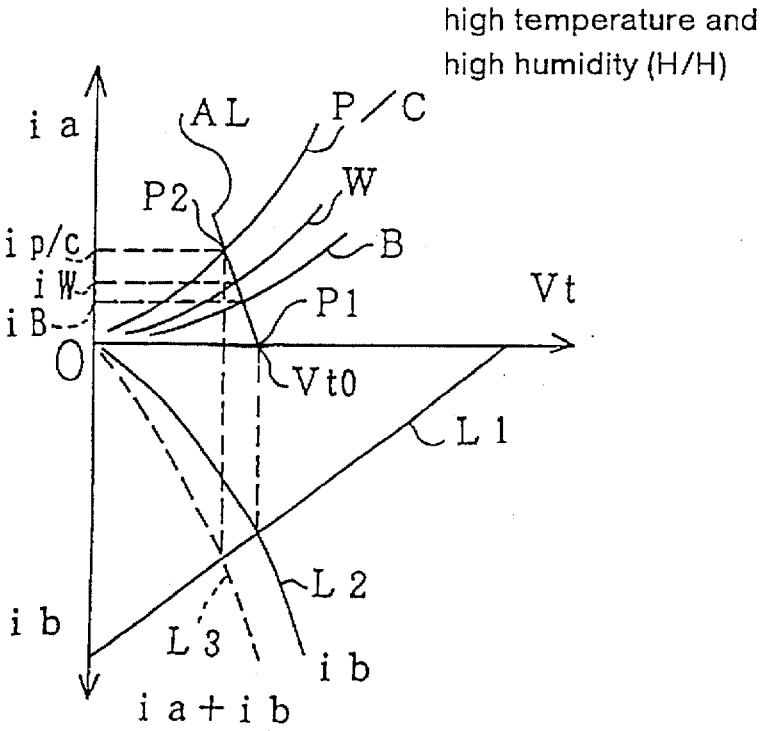
Figure 13:
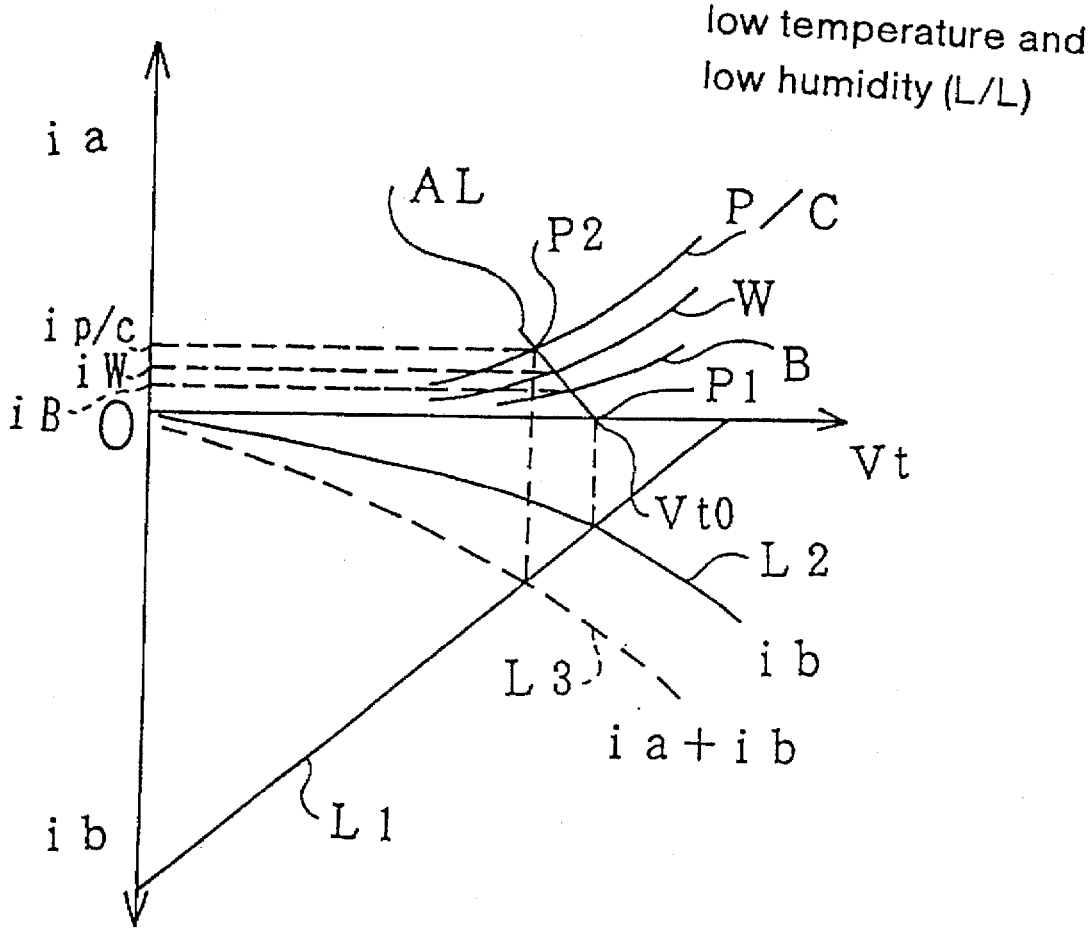

The operating characteristics are described below with reference to FIGS. 11 through 13. FIG. 11 describes operating characteristics under conditions of normal temperature and normal humidity (N/N); FIG. 12 described operating characteristics under conditions of high temperature and high humidity (H/H); FIG. 13 described operating conditions under conditions of low temperature and low humidity (L/L). In FIG. 11, the horizontal axis expresses voltage; the vertical axis expresses shunt circuit current ia from origin 0 upward, and the vertical axis expresses shunt circuit current ib from the origin 0 downward (the current flowing from reference electrode 50 through the surface pertion of the back side of intermediate transfer belt 20 to ground electrode roller 51). In the fourth quadrant, L1 is the operation line relative to control resistance Rs, L2 is the voltage dependency of current ib flowing through resistance Rb when ia=0, and L3 is the voltage dependency of current ia+ib when the voltage dependency of current ia is considered. In the first quadrant, P/C expresses the characteristics curve of the current flowing to photosensitive member 10, W expresses the characteristics curve of current flowing to the region not receiving transferred toner (white region), and B expresses the characteristics curve of the current flowing to the region receiving the transferred toner (black region). Furthermore, the values expressed in the characteristics curve P/C are equal to the difference between characteristics curves L2 and L3.

The voltage drop Vt0 induced by resistance Ra (which is equal to the voltage drop induced by resistance Rb) is determined as the coordinate P1 on the horizontal axis corresponding to the intersection point of operation line L1 and characteristics curve L2 based on the aforesaid characteristics curves. The current ip/c flowing to photosensitive member 10 is determined as the coordinate P2 on the Characteristics curve P/C corresponding to the intersection point of operation curve L1 and characteristics curve L2. The intersection coordinate of the Characteristics curve W and the operation line LAL connecting coordinate P1 and coordinate P2 expresses the current iW flowing to the white region, and the intersection coordinate of the operation curve AL and characteristics curve B expresses the current iB flowing to the black region. The operation line AL does not express the complete constant voltage, but approaches the relative constant voltage characteristics.

In an actual image forming apparatus, the current ip/c flowing to photosensitive member 10, current iW flowing to the white region, and current iB flowing to the black region can be individually determined by suitably setting the magnitude of the output voltage Vt of a constant high voltage power source El, control resistance Rs, and resistance Rb. The various current values may be set within a predetermined range.

For example, under the environmental conditions of high temperature and high humidity (H/H) shown in FIG. 12, the current ib flowing through resistance Rb increases compared to said current in a normal temperature and normal humidity (N/N) environment due to the reduced electrical resistance of belt 20 relative to the normal temperature and normal humidity conditions shown in FIG. 11. That is, the characteristics curve L2 of the current ib shifts to the high current side. Therefore, the voltage drop Vt0 induced by resistance Rb determined in the manner previously described is lower compared to the voltage drop under normal temperature and normal humidity (N/N) conditions.

On the other hand, the Characteristics curve P/C, Characteristics curve W, and Characteristics curve B corresponding to the transfer characteristics are each shifted to the low voltage side, and when the electrical resistance of belt 20 falls, the Characteristics curve P/C, characteristics curve W, and Characteristics curve B are shifted to the high current side, thereby increasing the voltage dependency and, as a result, increasing the slope of the operation line AL.

Therefore, the various current values ip/c, iW, and iB determined as previously described are equal values under normal environmental conditions of normal temperature and normal humidity.

Conversely, in a low temperature and low humidity (L/L) environment shown in FIG. 13, the current ib flowing through resistance Rb is less than the current under normal temperature and normal humidity (N/N) conditions due to the increased resistance relative the to normal temperature and normal humidity (N/N) conditions shown in FIG. 11. That is, the characteristics curve L2 d current ib shifts to the low current side. Therefore, the voltage drop VtO induced by resistance Rb determined as previously described is elevated relative to the current under normal temperature and normal humidity (N/N) conditions.

On the other hand, the Characteristics curve P/C, Characteristics curve W, and Characteristics curve B corresponding to the transfer characteristics are each shifted to the high voltage side, and when the electrical resistance of belt 20 increases, the Characteristics curve P/C, characteristics curve W, and Characteristics curve B are shifted to the low current side, thereby decreasing the voltage dependency and, as a result, decreasing the slope of the operation line AL.

Therefore, the various current values ip/c, iW, and iB determined as previously described are equal values under normal environmental conditions of normal temperature and normal humidity.

According to the previously described principle, in the transfer devices shown in FIGS. 8 and 9, the current ia flowing through the current path from primary transfer bias roller 28 through intermediate transfer belt 20 to photosensitive member 10 (corresponding to the current values ip/c, iW, and iB) are maintained at constant level even when the electrical resistance of belt 20 changes due to environmental fluctuations, thereby preventing insufficient transfers and background fog during times of fluctuating environmental conditions.

Modifications of the devices shown in FIGS. 8 and 9 are described below with reference to FIGS. 14 through 18. The devices of FIGS. 14 through 18 produce similar action via the same principle as previously described devices shown in FIGS. 8 and 9.

Figure 14:
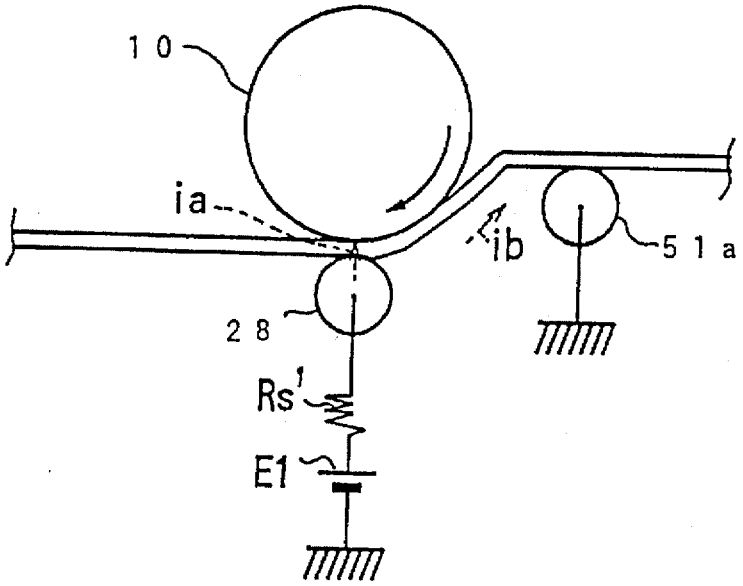
FIGS. 14, 15, 16, 17, and 18 respectively show modifications of the device of FIG. 8.

FIG. 14 shows a reference electrode 50 of the previously described device combined with the primary transfer bias roller 28. That is, in the previous device, the current between the primary transfer bias roller 28 and constant voltage source E1 was divided into currents ia and Ib, whereas in the device of FIG. 14, the current at the contact point of primary transfer bias roller 28 and belt 20 is divided into currents ia and ib. Accordingly, in the device of FIG. 14, the control resistance Rs is the sum of the internal resistance of primary transfer bias roller 28 and resistance Rs' in the drawing.

Thus, the reference electrode roller 50 of the previous device is omitted to lower cost, as well as to simplify construction and make a more compact device.

In FIG. 14, ground electrode roller 51 of the previous device is provided in front of primary transfer bias roller 28 as ground electrode roller 51*a*, such that the a reduction in transfer efficiency due to pretransfer discharge can be adequately suppressed by the regulation of belt 20 via said ground electrode roller 51*a* as the belt advances along photosensitive member 10. This construction is particularly effective for monocomponent contact type development using an applied high voltage. Furthermore, the aforesaid construction can control the reduction in transfer efficiency even when using a monocomponent non-contact type developing or two-component developing with a relatively low-voltage application, thereby generating latitude in the precision (tolerance) of control resistance Rs and precision (tolerance) of output voltage of constant voltage power source E1, so as to lower the cost of these components.

Figure 15:
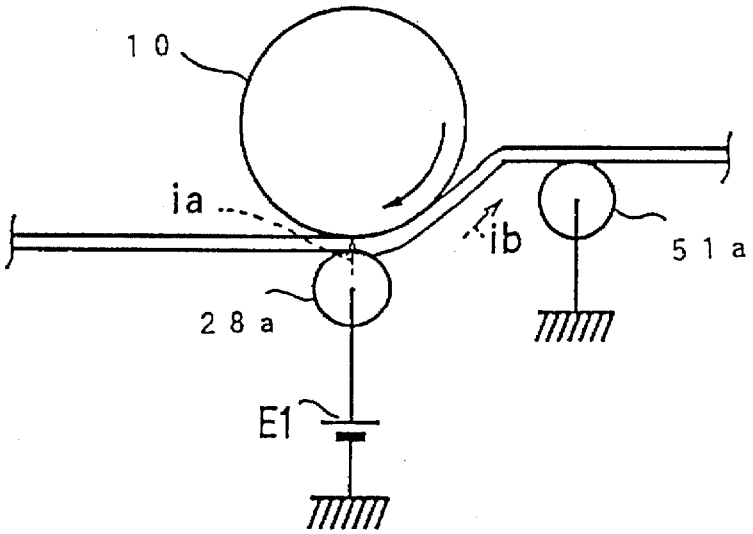

FIG. 15 shows a device using a conductive rubber roller 28*a* instead of the primary transfer bias roller 28 of the device in FIG. 14, wherein said conductive rubber roller 28*a* functions as a primary transfer bias roller, and wherein the resistance Rs' of the device of FIG. 14 is omitted by increasing the electrical resistance value of the conductive rubber roller. The volume resistivity value of conductive rubber roller 28*a* is $10^8\Omega$cm or greater.

The device of FIG. 15 has an effectiveness identical to the device of FIG. 14, while eliminating the resistance Rs'.

Figure 16:
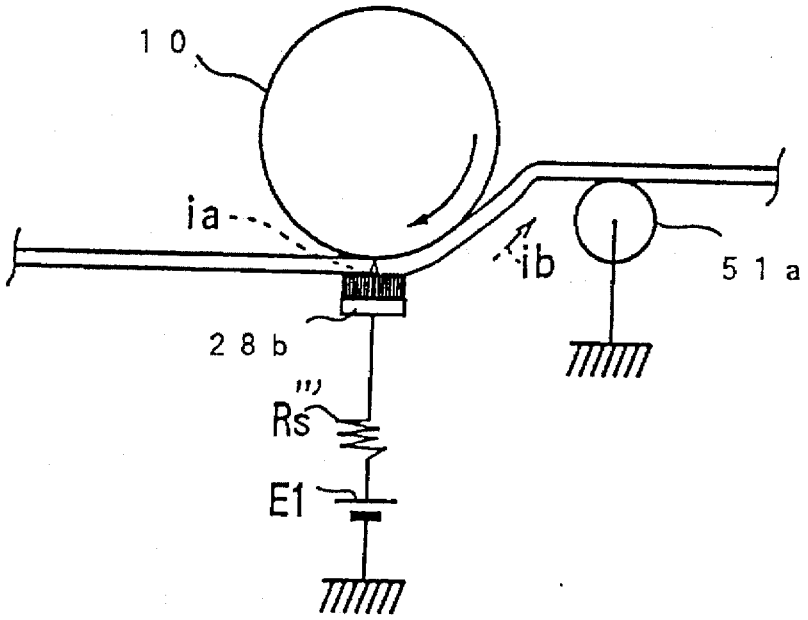

The device of FIG. 16 uses a conductive brush 28*b* instead of the primary transfer bias roller 28 of FIG. 14. Thus, low pressure contact with belt 20 is possible via the use of the fiber flexibility. Furthermore, incomplete transfer due to inadequate contact can be prevented by the reliable contact across the entire contact region of the belt 20 and the edge member conductive brush 28*b*. A film may be substituted for the conductive brush 28*b* with similar effect.

Figure 17:
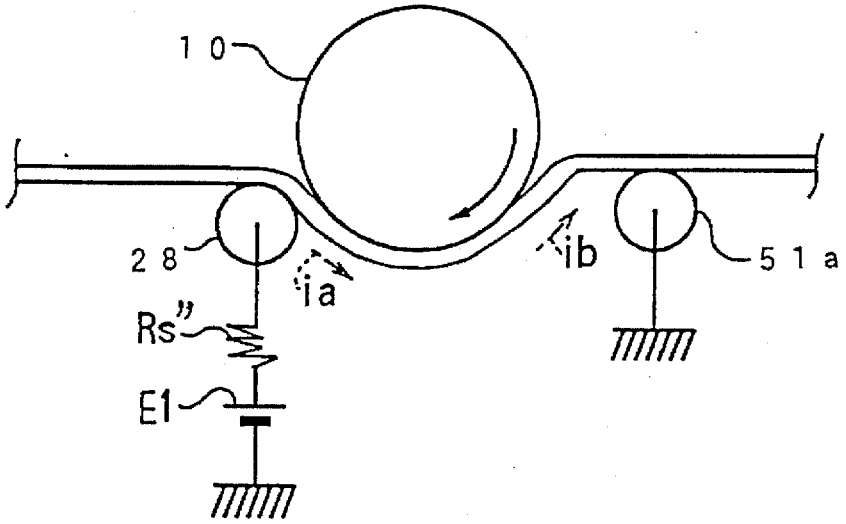

The device of FIG. 17 supports belt 20 via a primary transfer bias roller 28 and ground electrode roller 51*a* as in the device of FIG. 14. In this construction, incomplete transfer due to insufficient contact can be prevented because the nip can be increased between the belt 20 and photosensitive member 10. Furthermore, effective contact can be achieved at low pressure. In the case of FIG. 15, the bifurcation positions of current ia and current ib is distant from the ground electrode roller 51*a* (a position distance from belt 20 and photosensitive member 10), such that control resistance Rs is the sum of the resistance of belt 20 to the bifurcation position, the internal resistance of primary transfer bias roller 28, and resistance Rs" in the drawing.

Figure 18:
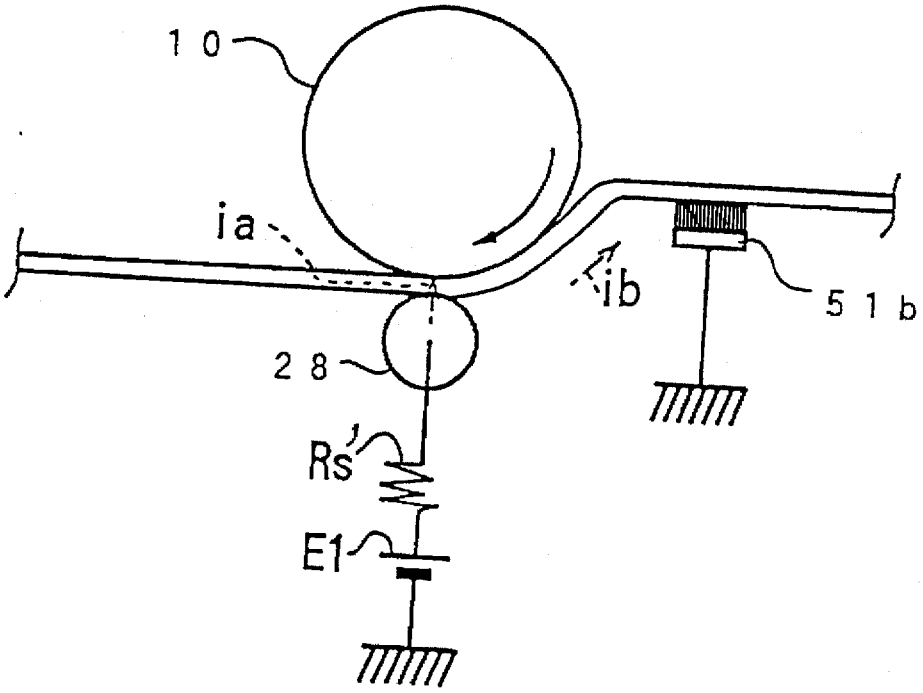

The device of FIG. 18 uses a ground electrode brush 51*b* instead of the ground electrode roller 51*a* of the device in FIG. 14. In this construction, contact stability is assured in response to oscillation of belt 20 in one direction and an opposite direction. Thus, elevation of the potential of primary transfer bias roller 28 can be prevented, thereby preventing transfer insufficiency and damage to the belt 20. Similar effectiveness can be obtained by using a film or blade instead of the contact electrode brush 51*b*.

Each of the devices shown in FIGS. 8 and 9 and FIGS. 14 through 18 may adapt the present invention to a device wherein the intermediate transfer belt 20 itself transfers a toner image.

A sheet transport type transfer belt device is described below with reference to FIG. 19, and a sheet transport type transfer drum device is described below with reference to FIG. 20.

Figure 19:
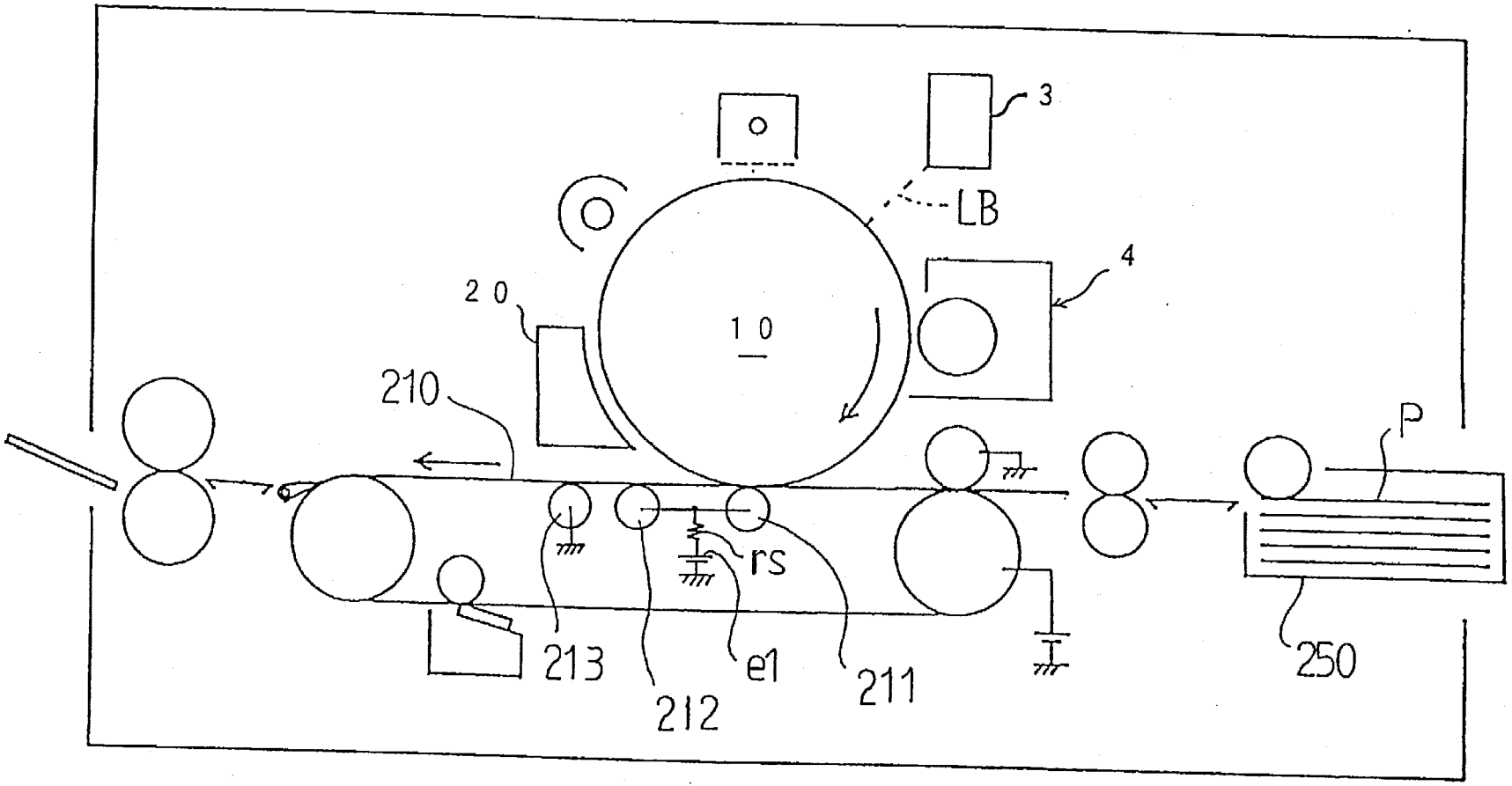
FIG. 19 shows the construction of a transfer belt using the sheet transport method illustrating the principle of the device of FIG. 8.

The device of FIG. 19 is a sheet transport type transfer belt device wherein a sheet P accommodated in tray 250 is output via a belt 210, and a toner image is transferred to sheet P at said transfer position.

The device of FIG. 19 is provided on the back side of belt 210 with a transfer bias roller 211, reference electrode roller 212, ground electrode roller 213, control resistance rs, and constant voltage power source el similar to the device of FIGS. 8 and 9, and provides an effectiveness similar to the devices of FIGS. 8 and 9. The device of FIG. 13 may be modified in ways similar to the devices of FIGS. 14 through 18.

Figure 20:
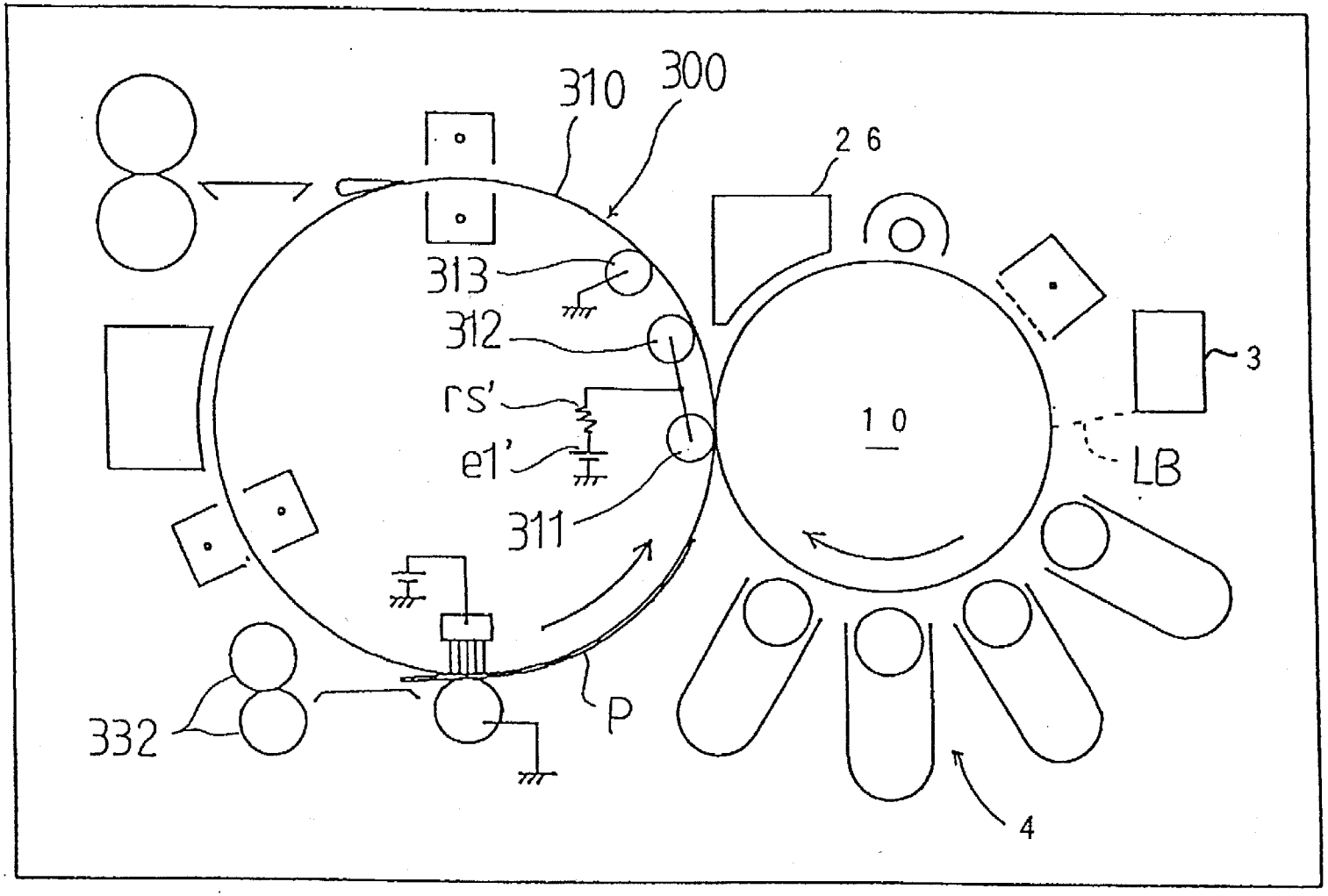
FIG. 20 shows the construction of a transfer drum device using the sheet transport method illustrating the principle of the device of FIG. 8.

The device of FIG. 20 is a sheet transport type transfer drum device wherein a sheet P is fed from timing roller 332 with a timing synchronized with the leading edge of a toner image on photosensitive drum 10, and is maintained on a film 310 provided on the surface of transfer drum 300, said sheet P being transported to a transfer position pressed against photosensitive drum 10 to receive the transferred toner image at said transfer position.

The device of FIG. 20 is provided on the back side of belt 310 with a transfer bias roller 311, reference electrode roller 312, ground electrode roller 313, control resistance rs', and constant voltage power source e1' similar to the device of FIGS. 8 and 9, and provides an effectiveness similar to the devices of FIGS. 8 and 9 and 13. The device of FIG. 14 may be modified in ways similar to the devices of FIGS. 14 through 18.

The device described above uses surface resistance circuits formed along the surface of belts 20, 210 and film 310 as parallel resistance circuits in the current path from the end element of transfer bias rollers 28, 211, and 311 through the sheet-like member of belt 20 (or sheet-like member of belt 210 and film 310, and sheet P) to photosensitive drum 10.

In the previously described construction, when the electrical resistance of the sheet-like member fluctuates due to environmental fluctuations, the electrical resistance of the parallel resistance circuits from the terminal member through the sheet-like member to the photosensitive member similarly fluctuates, such that an electrical load of a desired amount can be supplied to the sheet-like member and paper so as to maintain a constant current value flowing from the terminal member through the sheet-like member to the photosensitive member regardless of temperature and humidity fluctuations, thereby preventing transfer insufficiencies and background fog. Furthermore, the aforesaid effect can be achieved by a relatively simple construction of adding a ground end member and control resistance, thereby avoiding a more complex and larger device.

Figure 21:
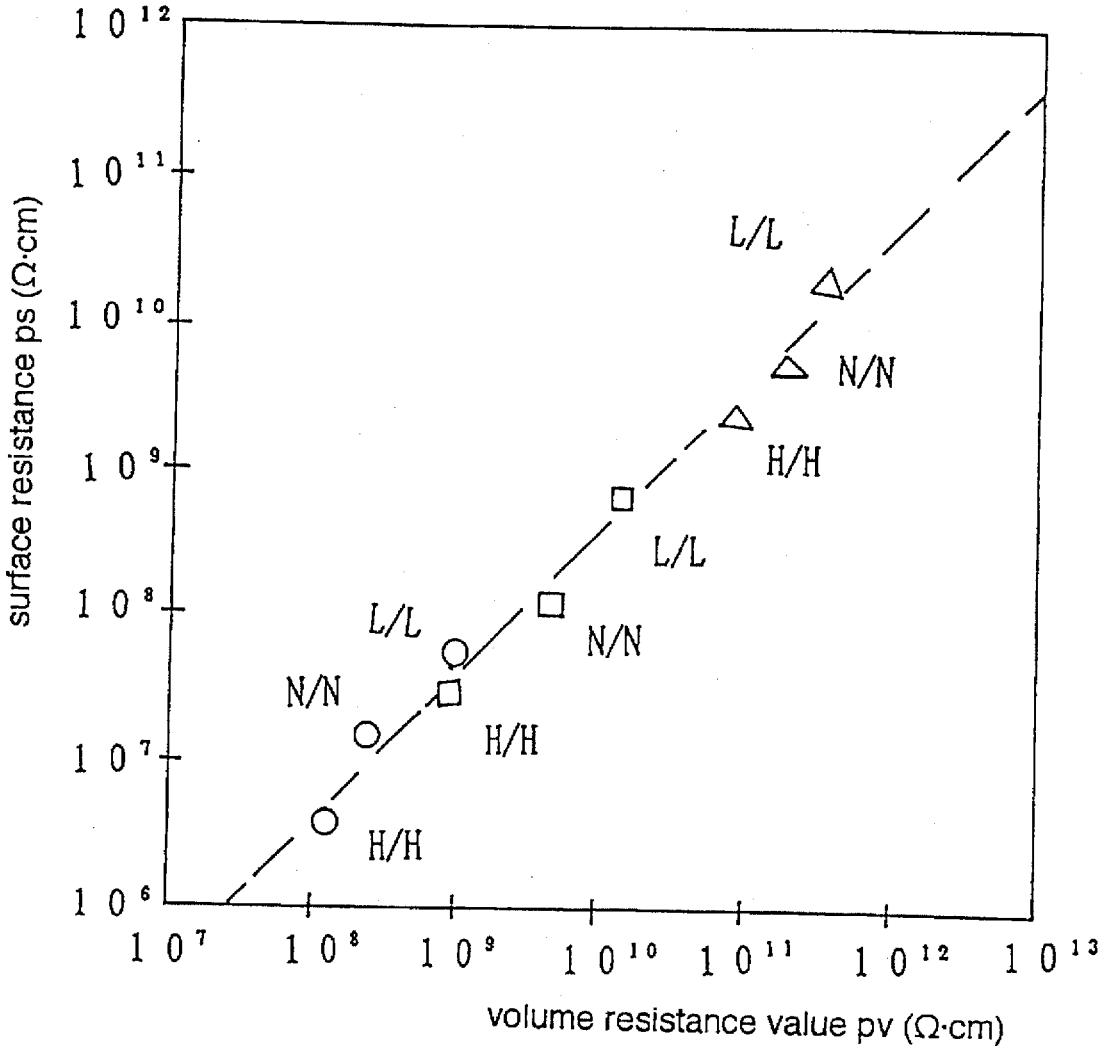
FIG. 21 is a graph plotting volume resistivity pV and surface resistivity ps under various environments of the belt (sheet-like member) used in the device of FIG. 8.

FIG. 21 is a graph plotting the volume resistance value pv and surface resistance ps under environmental conditions of high temperature and high humidity (H/H), normal temperature and normal humidity (N/N), and low temperature and low humidity (L/L) relative to a sheet-like member (e.g., a belt comprising a conductive filler such as carbon black dispersed in a fluororesin having a thickness of 150μm, and having low volume resistivity, intermediate volume resistivity, and high volume resistivity) used as a transfer belt. As shown in the drawing, volume resistivity value pv and surface resistivity value ps have a relatively strong correlations in all resistance examples. Thus, when resistance (volume resistivity) fluctuates in the thickness direction of the aforesaid sheet-like member, the electrical resistance (surface resistance) of said sheet-like member can be expected to similarly fluctuate so as to act as previously described.

Materials other than fluororesins having a relatively strong correlation between volume resistivity value pv and surface resistivity value ps, e.g., urethane resin, urethane rubber, EPDM, polycarbonate, silicone resin, silicone rubber and the like, may be used as the sheet-like member of the transfer device of the present invention.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What claimed is:

1. An image forming apparatus comprising:

a toner image carrying member which carries a toner image;

an intermediate transfer member opposite to the toner image carrying member;

a charging device which charges the intermediate transfer member for transferring the toner image from the toner image carrying member;

a resistance;

a power source which is connected to the charging device through said resistance and supplies the charging device with electric current; and a grounding electrode which contacts the intermediate transfer member, said grounding electrode being located so that a circuit from the resistance to the grounding electrode is in parallel with a circuit from the resistance to the toner image carrying member.

2. The image forming apparatus as claimed in claim 1, wherein said toner image carrying member is electrostatic latent image carrying member.

3. The image forming apparatus as claimed in claim 1, wherein said charging device is a conductive roller.

4. The image forming apparatus as claimed in claim 1, wherein said intermediate transfer member is an intermediate transfer belt.

5. The image forming apparatus as claimed in claim 1, further comprising:

a transfer device transferring the toner image from the intermediate transfer member to a recording medium.

6. The image forming apparatus as claimed in claim 5, wherein said transfer device is a conductive roller.

7. The image forming apparatus as claimed in claim 5, wherein said intermediate transfer member is an intermediate transfer belt.

8. The image forming apparatus as claimed in claim 7, further comprising:

a comparing electrode which is connected to the intermediate transfer belt, said comparing electrode being arranged at a downstream side from the charging device with respect to a moving direction of said intermediate transfer belt, and said grounding electrode being arranged at a downstream side from said comparing electrode with respect to the moving direction of said intermediate transfer belt.

9. The image forming apparatus as claimed in claim 1, wherein said grounding electrode is arranged at an upstream side from the charging device with respect to a moving direction of said intermediate transfer member.

10. The image forming apparatus as claimed in claim 9, wherein said charging device is a conductive roller including the resistance.

11. The image forming apparatus as claimed in claim 1, wherein said charging device is a conductive brush.

12. The image forming apparatus as claimed in claim 1, wherein said grounding electrode is a conductive brush.

13. An image forming apparatus comprising:

a toner image carrying member which carries a toner image;

a transfer member opposite to the toner image carrying member;

a charging device which charges the transfer member for transferring the toner image from the toner image carrying member;

a resistance;

a power source which is connected to the charging device through said resistance and supplies the charging device with electric current; and a grounding electrode which contacts the transfer member, said grounding electrode being located so that a circuit from the resistance to the grounding electrode is in parallel with a circuit from the resistance to the toner image carrying member.

14. The image forming apparatus as claimed in claim 13, wherein said toner image carrying member is electrostatic latent image carrying member.

15. The image forming apparatus as claimed in claim 13, wherein said charging device is a conductive roller.

16. The image forming apparatus as claimed in claim 13, wherein said grounding electrode is arranged at an upstream side from the charging device with respect to a moving direction of said transfer member.

17. The image forming apparatus as claimed in claim 13, wherein said charging device is a conductive roller including the resistance.

18. The image forming apparatus as claimed in claim 13, wherein said charging device is a conductive brush.

19. The image forming apparatus as claimed in claim 13, wherein said grounding electrode is a conductive brush.

* * * * *